US007288926B2

(12) United States Patent
Lee et al.

(10) Patent No.: US 7,288,926 B2
(45) Date of Patent: Oct. 30, 2007

(54) INTERNAL POWER VOLTAGE GENERATOR FOR REDUCING CURRENT CONSUMPTION

(75) Inventors: Byeong-Hoon Lee, Seoul (KR); Sun-Kwon Kim, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 455 days.

(21) Appl. No.: 11/050,639

(22) Filed: Feb. 3, 2005

(65) Prior Publication Data

US 2006/0061346 A1 Mar. 23, 2006

(30) Foreign Application Priority Data

Sep. 20, 2004 (KR) ..... 10-2004-0075147

(51) Int. Cl.
*G05F 3/16* (2006.01)

(52) U.S. Cl. ..... 323/314; 327/539; 327/407

(58) Field of Classification Search ..... 323/312, 323/313, 314, 315, 316; 307/407, 539, 540
See application file for complete search history.

(56) References Cited

U.S. PATENT DOCUMENTS 5,367,249 A 11/1994 Honnigford
6,683,445 B2 * 1/2004 Park ..... 323/315
2003/0001554 A1 1/2003 Park
2004/0046538 A1 3/2004 Sivero et al.
2005/0017704 A1 * 1/2005 Mo et al. ..... 323/313

FOREIGN PATENT DOCUMENTS

| | | |
|---|---|---|
| DE | 10215084 | 10/2003 |
| JP | 10-049243 | 2/1998 |
| JP | 11-231954 | 8/1999 |
| KR | 2001-0029732 | 4/2001 |

* cited by examiner

*Primary Examiner*—Jessica Han
(74) *Attorney, Agent, or Firm*—F. Chau & Associates, LLC

(57) ABSTRACT

An internal voltage generator and method are provided, the internal voltage generator including a first reference voltage generator for receiving an external voltage and providing a first reference voltage, a second reference voltage generator for receiving an internal voltage and providing a second reference voltage, and a voltage regulator in signal communication with the first reference voltage generator and/or the second reference voltage generator for receiving one of the first and second reference voltages and providing the internal voltage; and the method for generating an internal voltage including receiving an external voltage, generating a first reference voltage responsive to the received external voltage, regulating an internal voltage in correspondence with the first reference voltage, generating a second reference voltage responsive to the internal voltage, and regulating the internal voltage in correspondence with the second reference voltage.

26 Claims, 8 Drawing Sheets

INTERNAL POWER VOLTAGE GENERATOR FOR REDUCING CURRENT CONSUMPTION

BACKGROUND

The present disclosure relates to integrated circuits, and more particularly, to internal power voltage generators of integrated circuits.

As integration increases and chip sizes fall, many scaled-down semiconductors utilize a reduced power voltage level relative to the chips they replace. The external power voltage supplied to an existing system design is slow to be changed as compared with the chip because it is more difficult and/or costly to simultaneously alter the power voltage of all of the various chips within the system. Systems with various external power supply voltages, such as 1.8V through 5.0V, coexist in the market.

Therefore, semiconductor chips are desired where each includes an internal power voltage generator to generate a constant power voltage regardless of the various external supply voltages. Such chips can be used in various systems with different external power voltages without requiring system redesign. In addition, a low current consumption and/or a corresponding low heat production are desirable in many applications.

SUMMARY

An exemplary embodiment internal voltage generator includes a first reference voltage generator for receiving an external voltage and providing a first reference voltage, a second reference voltage generator for receiving an internal voltage and providing a second reference voltage, and a voltage regulator in signal communication with the first reference voltage generator and/or the second reference voltage generator for receiving one of the first and second reference voltages and providing the internal voltage.

An exemplary embodiment method for generating an internal voltage includes receiving an external voltage, generating a first reference voltage responsive to the received external voltage, regulating an internal voltage in correspondence with the first reference voltage, generating a second reference voltage responsive to the internal voltage, and regulating the internal voltage in correspondence with the second reference voltage.

These and other features of the present disclosure will become apparent from the following description of exemplary embodiments, which is to be read in connection with the accompanying drawings.

BRIEF DESCRIPTION OF THE DRAWINGS

The present disclosure teaches a method and apparatus for internal power voltage generation in accordance with the following exemplary figures, in which.

DETAILED DESCRIPTION OF PREFERRED EMBODIMENTS

Figure 1:
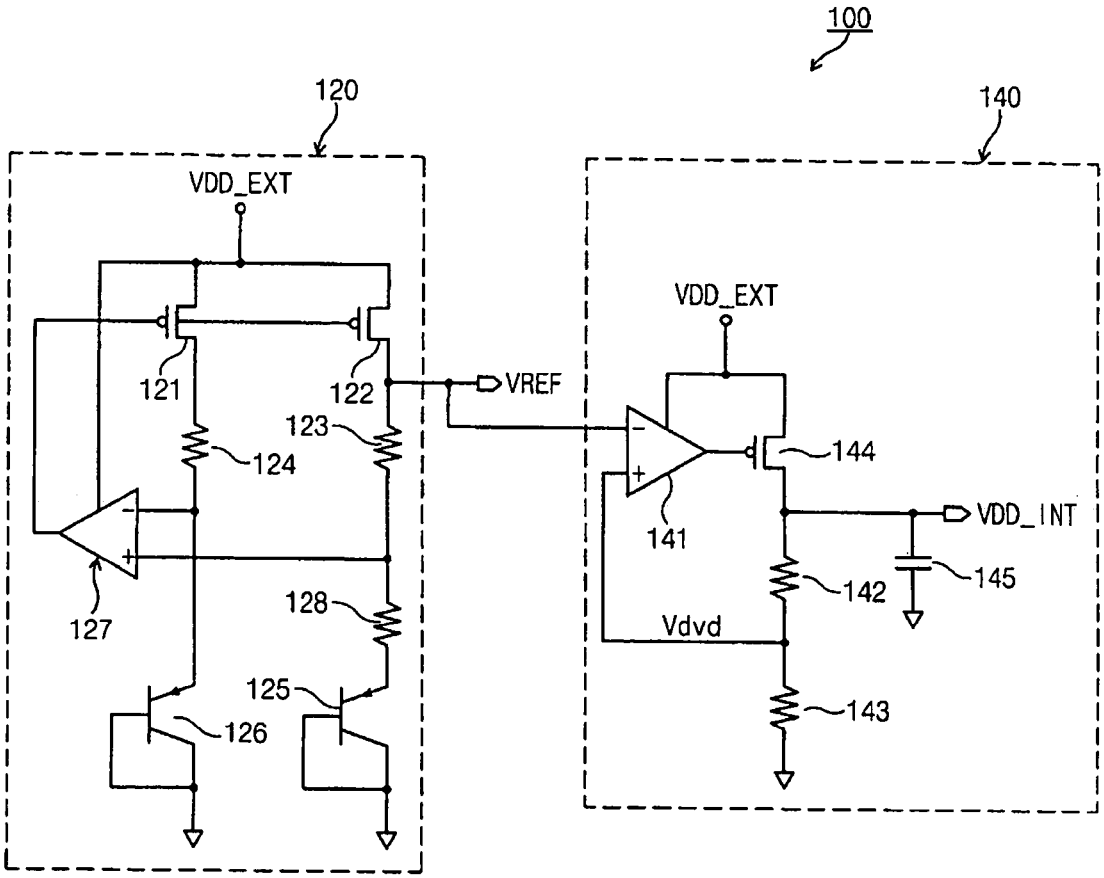
Fig. 1 (PRIOR ART)
FIG. 1 is a schematic diagram showing a conventional internal power voltage generator.

As shown in FIG. 1, an internal power voltage generator (IVG) is indicated generally by the reference numeral 100. The IVG 100 includes a reference voltage generator 120 connected to a voltage regulator 140.

The reference voltage generator (Ref_Gen) 120 is a band-gap reference generator. The reference voltage generator 120 includes a first PMOS transistor 121 having a source terminal connected to an external power voltage (VDD_EXT), a gate terminal connected to the output terminal of a comparator 127, which is powered by the external power voltage, and a drain terminal connected to a resistor 124. The other end of the resistor 124 is connected to the inverting input terminal of the comparator 127, and to the first terminal of a BJT transistor 126 that has its second terminal grounded. The reference voltage generator 120 further includes a second PMOS transistor 122 having a source terminal connected to the external power voltage VDD_EXT, a gate terminal connected to the output terminal of the comparator 127, and a drain terminal connected to a resistor 123. The other end of the resistor 123 is connected to the non-inverting input terminal of the comparator 127, and to a resistor 128. The other end of the resistor 128 is connected to the first terminal of a BJT transistor 125 that has its second terminal grounded. The output of the internal power voltage generator 120 is a reference voltage (VREF) from the drain terminal of the PMOS 122. Thus, the reference voltage generator 120 generates the reference voltage VREF using the external power voltage VDD_EXT.

The voltage regulator 140 includes a comparator 141, powered by the external voltage VDD_EXT, and having its inverting input terminal connected to the voltage reference signal VREF. The output terminal of the comparator 141 is connected to the gate terminal of a PMOS transistor 144, which has its source terminal connected to the external power voltage VDD_EXT. The drain terminal of the PMOS transistor 144 is connected to a resistor 142 and a capacitor 145, where the other end of the capacitor is connected to ground. The other end of the resistor 142 connects a divided voltage Vdvd to the non-inverting input of the comparator 141, and is also connected to a resistor 143. The other end of the resistor 143 is connected to ground. The output of the voltage regulator 140 is an internal power voltage VDD_INT from the drain terminal of the PMOS transistor 144. Thus, the voltage regulator 140 converts the external power voltage VDD_EXT into the internal power voltage VDD_INT based on the reference voltage VREF.

In an exemplary method of operation of the internal power voltage generator 100, if VDD_EXT is 5V, VDD_INT is 1.5V and VREF is 1.2V, the operation flow of the IVG 100 is as follows:

In a generation step, the Ref_Gen 120 generates the reference voltage VREF using VDD_EXT.

In a comparison step, the divided voltage Vdvd, divided by resisters 142 and 143, is inputted to the positive or non-inverting terminal and the VREF is inputted to the negative or inverting terminal of the comparator 141 within the VR 140.

In a regulation step, the comparator controls the gate voltage of the PMOS 144 in response to VREF and Vdvd such that when Vdvd is lower than VREF, the gate voltage of the PMOS becomes decreased and a current is supplied from VDD_EXT to VDD_INT, and the VDD_INT increases to a predetermined voltage level, which is 1.5V in this example; and such that when Vdvd is higher than VREF, the gate voltage of the PMOS becomes increased and a current from VDD_EXT to VDD_INT is cut-off and the VDD_INT is maintained at the predetermined voltage level. When the current consumption of internal circuits within the system causes the VDD_INT to be decreased, the gate voltage of the PMOS becomes decreased and a current is supplied.

The comparison and regulation steps are repeated. Thus, the internal power voltage VDD_INT level is constantly maintained at the predetermined voltage level.

The Ref_Gen 120 generates VREF using VDD_EXT and the VR 140 receives VDD_EXT and generates VDD_INT based on the VREF. The Ref_Gen 120 and the VR 140 use the external voltage VDD_EXT as operating voltage. Various systems in which the internal voltage generator 100 is to be used utilize various external voltages, such as 5V, 3.3V, 1.8V, etc., for example.

The IVG 100 should generate constant internal power voltage regardless of external supply voltage. For maintaining a constant internal power voltage, the reference voltage generator 120 needs to generate the reference voltage VREF with constant voltage level regardless of the external voltage supplied to systems. That is, the Ref_Gen 120 must support systems with a wide range of external power voltages.

Figure 2:
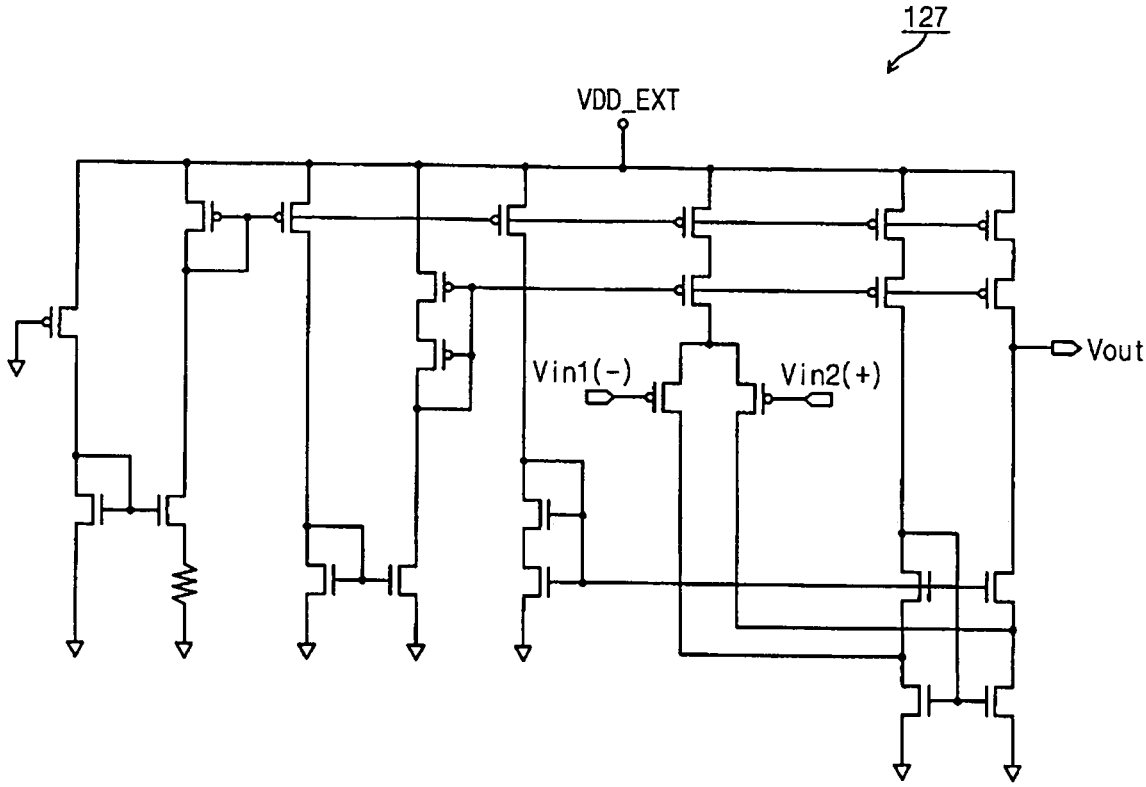
Fig. 2 (PRIOR ART)
FIG. 2 is a schematic diagram showing a conventional comparator circuit of the internal power voltage generator of FIG. 1 in greater detail.

Turning to FIG. 2, the comparator 127 of FIG. 1 is shown in greater detail. The comparator circuit 127 is used in the conventional internal power voltage generator 100 of FIG. 1. The comparator 127 includes ten NMOS transistors and fourteen PMOS transistors, which together consume a proportional and relatively high amount of current. Such a complex comparator 127 is required for the IVG 100 in order to achieve and maintain a relatively constant internal power voltage VDD_INT. Thus, the reference voltage generator 120 is very complex, in turn, by its inclusion of the complex comparator 127, and likewise consumes a relatively high amount of current.

Figure 3:
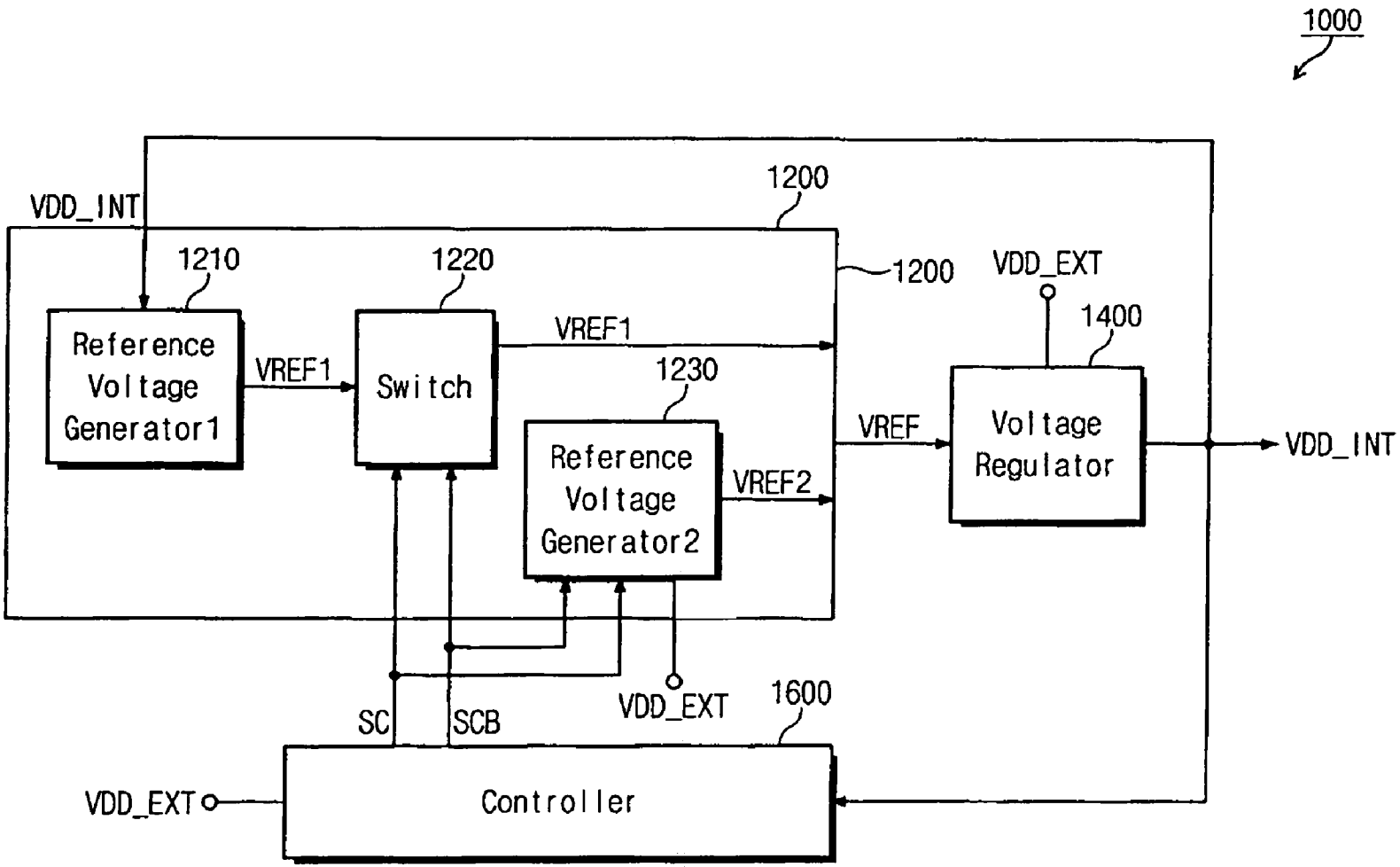
FIG. 3 is a schematic diagram showing an internal power voltage generator in accordance with an exemplary embodiment of the present disclosure.

Turning now to FIG. 3, an internal power voltage generator in accordance with an exemplary embodiment of the present disclosure is indicated generally by the reference numeral 1000. The internal power voltage generator 1000 includes a controller 1600 for receiving external and internal power voltages, a reference voltage generation block 1200 connected to the controller, and a voltage regulator 1400 connected to the reference voltage generation block. The controller 1600 provides control signals SC and SCB to the reference voltage generation block 1200. The voltage regulator 1400 is like the voltage regulator 140 of FIG. 1, so redundant description will be avoided.

The reference voltage generation block 1200 includes a first reference voltage generator 1210 for receiving the internal power voltage VDD_INT and providing a first reference voltage VREF1 to a switch 1220 for selective transmission to the voltage regulator 1400, and a second reference voltage generator 1230 for receiving the external power voltage VDD_EXT and providing a second reference voltage VREF2 for selective transmission to the voltage regulator 1400. The switch 1220 and the second reference voltage generator 1230 each receive the control signals SC and SCB from the controller 1600, and either the switch provides the first reference voltage VREF1 as the voltage reference VREF to the voltage regulator 1400, or the second reference voltage generator provides the second reference voltage VREF2 as the voltage reference VREF to the voltage regulator 1400.

Figure 4:
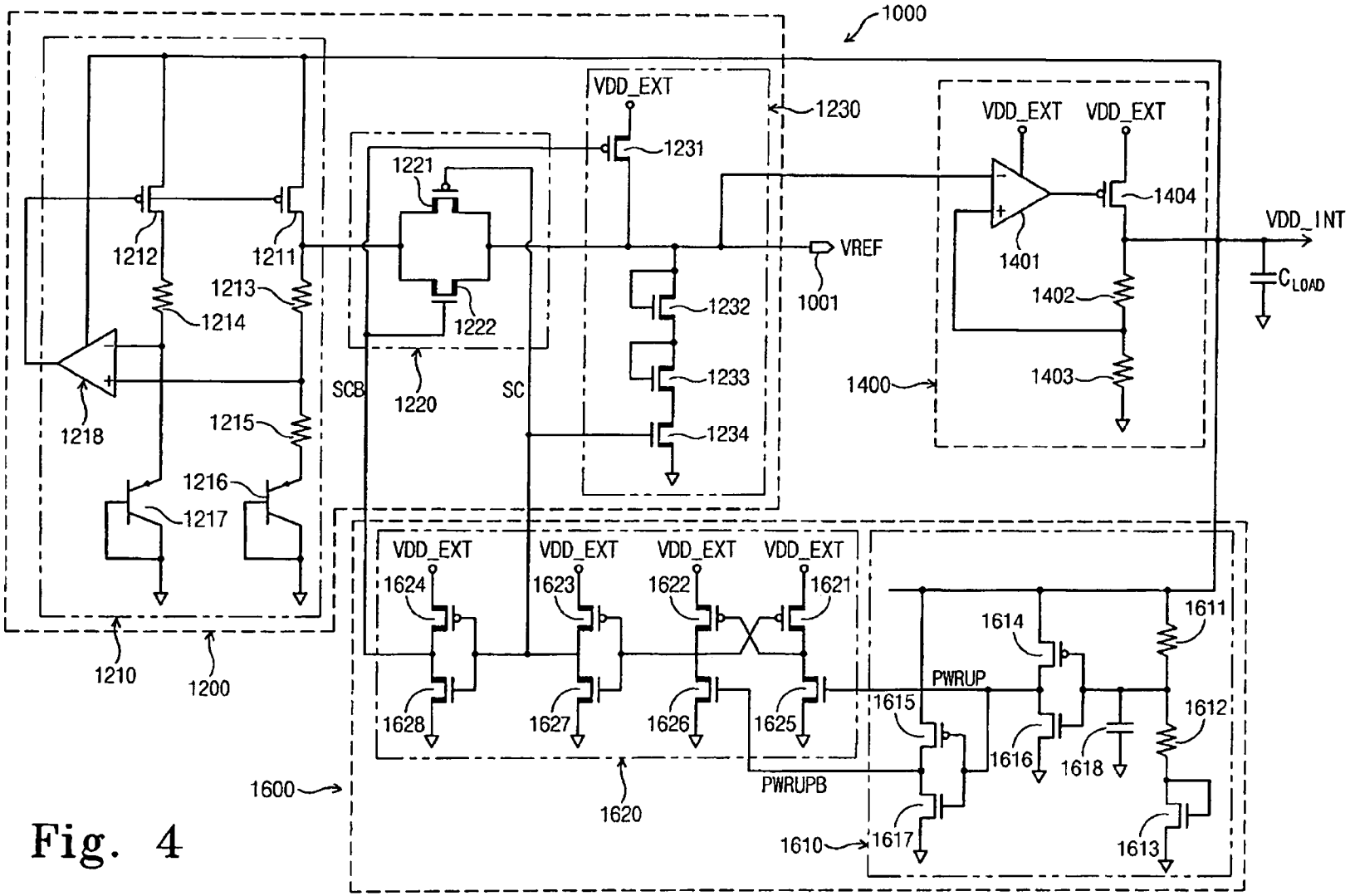
FIG. 4 is a schematic diagram showing the internal power voltage generator of FIG. 3 in greater detail.
Figure 5:
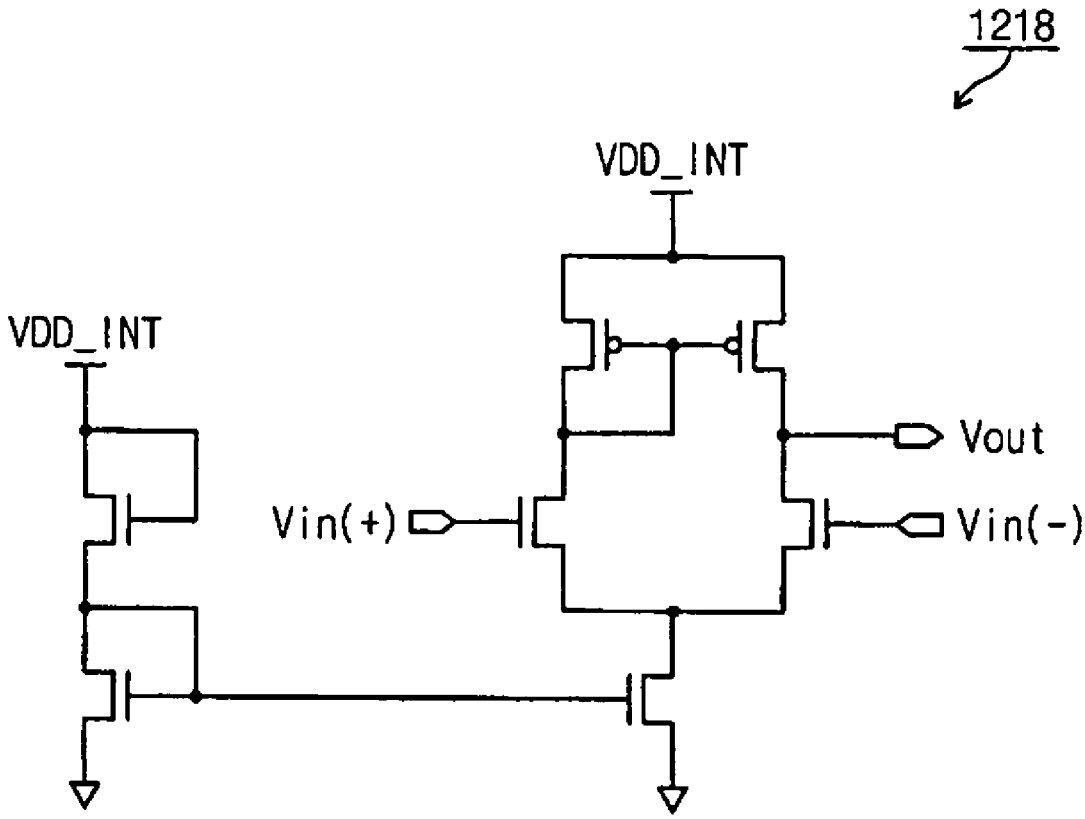
FIG. 5 is a schematic diagram showing a comparator circuit of the internal power voltage generator of FIG. 4 in greater detail.

As shown in FIG. 4, the internal power voltage generator 1000 of FIG. 3 is shown in greater detail. At this level of detail, the first reference voltage generator 1210 looks superficially like the reference voltage generator 120 of FIG. 1, although the details of the comparator 1218, which is to be described with respect to FIG. 5, are substantially different from the details of the comparator 127 of FIG. 1, which were described in detail with respect to FIG. 2. Another important difference between the reference voltage generator 120 of FIG. 1 and the first reference voltage generator 1210 of FIG. 5 is that while the generator 120 received the external power voltage VDD_EXT, the generator 1210 instead receives the internal power voltage VDD_INT as described below.

The first reference voltage generator 1210 includes a first PMOS transistor 1212 having a source terminal connected to the internal power voltage VDD_INT, a gate terminal connected to the output terminal of the comparator 1218, which is powered by the internal power voltage, and a drain terminal connected to a resistor 1214. The other end of the resistor 1214 is connected to the inverting input terminal of the comparator 1218, and to the first terminal of a BJT transistor 1217 that has its second terminal grounded. The first reference voltage generator 1210 further includes a second PMOS transistor 1211 having a source terminal connected to the internal power voltage VDD_INT, a gate terminal connected to the output terminal of the comparator 1218, and a drain terminal connected to a resistor 1213. The other end of the resistor 1213 is connected to the non-inverting input terminal of the comparator 1218, and to a resistor 1215. The other end of the resistor 1215 is connected to the first terminal of a BJT transistor 1216 that has its second terminal grounded. The output of the internal power voltage generator 1210 is a first reference voltage (VREF1) from the drain terminal of the PMOS 1211. Thus, the reference voltage generator 1210 generates the first reference voltage VREF1 using the internal power voltage VDD_INT.

The controller 1600 includes a voltage detector 1610 connected to the internal power voltage VDD_INT, and a level shifter 1620 connected to the detector 1610 and the external power voltage VDD_EXT. The voltage detector 1610 includes a first resistor 1611 connected to the internal voltage VDD_INT. The other end of the first resistor is connected to a second resistor 1612, which, in turn, has its other end connected to both the drain and gate of an NMOS transistor 1613, the source of which is connected to ground. The other end of the first transistor 1611 is also connected to a capacitor 1618, the other end of which is connected to ground. The other end of the first transistor 1611 is further connected to the gates of a PMOS transistor 1614 and an NMOS transistor 1616. The source of the PMOS transistor 1614 is connected to the internal power voltage VDD_INT, and its drain is connected to the drain of the NMOS transistor 1616, where the source of the NMOS transistor 1616 is connected to ground. The drain of the PMOS transistor 1614 provides a signal PWRUP that is also connected to the gates of a PMOS transistor 1615 and an NMOS transistor 1617, as well as to the level shifter 1620. The source of the PMOS transistor 1615 is connected to the internal power voltage VDD_INT, and its drain is connected to the drain of the NMOS transistor 1617, where the source of the NMOS transistor 1617 is connected to ground. The drain of the PMOS transistor 1615 provides a signal PWRUPB that is also connected to the level shifter 1620.

The level shifter 1620 includes first and second PMOS transistors 1621 and 1622, which each have their sources connected to the external power voltage VDD_EXT. The drain of the PMOS transistor 1621 is connected to the gate of the PMOS transistor 1622, while the drain of the PMOS transistor 1622 is connected to the gate of the PMOS transistor 1621. The drain of the PMOS transistor 1621 is also connected to the drain of an NMOS transistor 1625. The NMOS transistor 1625 has its gate connected to the PWRUP signal from the voltage detector 1610, and has its source connected to ground. The drain of the PMOS transistor 1622 is also connected to the drain of an NMOS transistor 1626. The NMOS transistor 1626 has its gate connected to the PWRUPB signal from the voltage detector 1610, and has its source connected to ground. The drain of the PMOS transistor 1622 is further connected to the gates of a PMOS transistor 1623 and an NMOS transistor 1627. The source of the PMOS transistor 1623 is connected to the external power voltage VDD_EXT, while its drain is connected to the drain of the NMOS transistor 1627. The source of the NMOS transistor 1627 is connected to ground. The drain of the PMOS transistor 1623 provides the control signal SC, which is connected to the gates of a PMOS transistor 1624 and an NMOS transistor 1628. The source of the PMOS transistor 1624 is connected to the external power voltage VDD_EXT, while its drain is connected to the drain of the NMOS transistor 1628. The source of the NMOS transistor 1628 is connected to ground. The drain of the PMOS transistor 1624 provides the control signal SCB.

The second reference voltage generator 1230 includes a PMOS transistor 1231 with its gate connected to the control signal SCB from the controller 1600. The source of the PMOS transistor 1231 is connected to the external power voltage VDD_EXT, while its drain provides the reference voltage VREF2 that is used as VREF. The drain of the PMOS transistor 1231 is also connected to the drain and gate of an NMOS transistor 1232, which, in turn, has its source connected to the drain and gate of an NMOS transistor 1233. The source of the NMOS transistor 1233 is connected to the drain of an NMOS transistor 1234. The gate of the NMOS transistor 1234 is connected to the control signal SC from the controller 1600, while its source is connected to ground.

The switch 1220 includes a PMOS transistor 1221 having its gate connected to the control signal SC from the controller 1600, and an NMOS transistor 1222 having its gate connected to the control signal SCB from the controller 1600, where the PMOS 1221 and the NMOS 1222 are connected source to drain and drain to source, respectively. The source of the transistor 1221 is further connected to the first reference voltage VREF1 from the first reference voltage generator 1210, while the drain of the transistor 1221 is further connected to the second reference voltage VREF2 terminal from the second reference voltage generator 1230 as well as the final reference voltage VREF terminal.

Turning to FIG. 5, the comparator 1218 of FIG. 4 is shown in greater detail. The comparator circuit 1218 is preferably used in the internal power voltage generator 1000 of FIG. 5. In contrast with the comparator 127 of FIG. 2, which includes ten NMOS transistors and fourteen PMOS transistors, the comparator 1218 of FIG. 5 includes only two PMOS transistors and five NMOS transistors. Thus, the comparator 1218 is less complex and requires less current than the comparator 127 of FIG. 2. This reduction in complexity and current consumption is made possible by the fact that the comparator 1218 receives the regulated internal voltage VDD_INT rather than the external voltage VDD_EXT.

Figure 6:
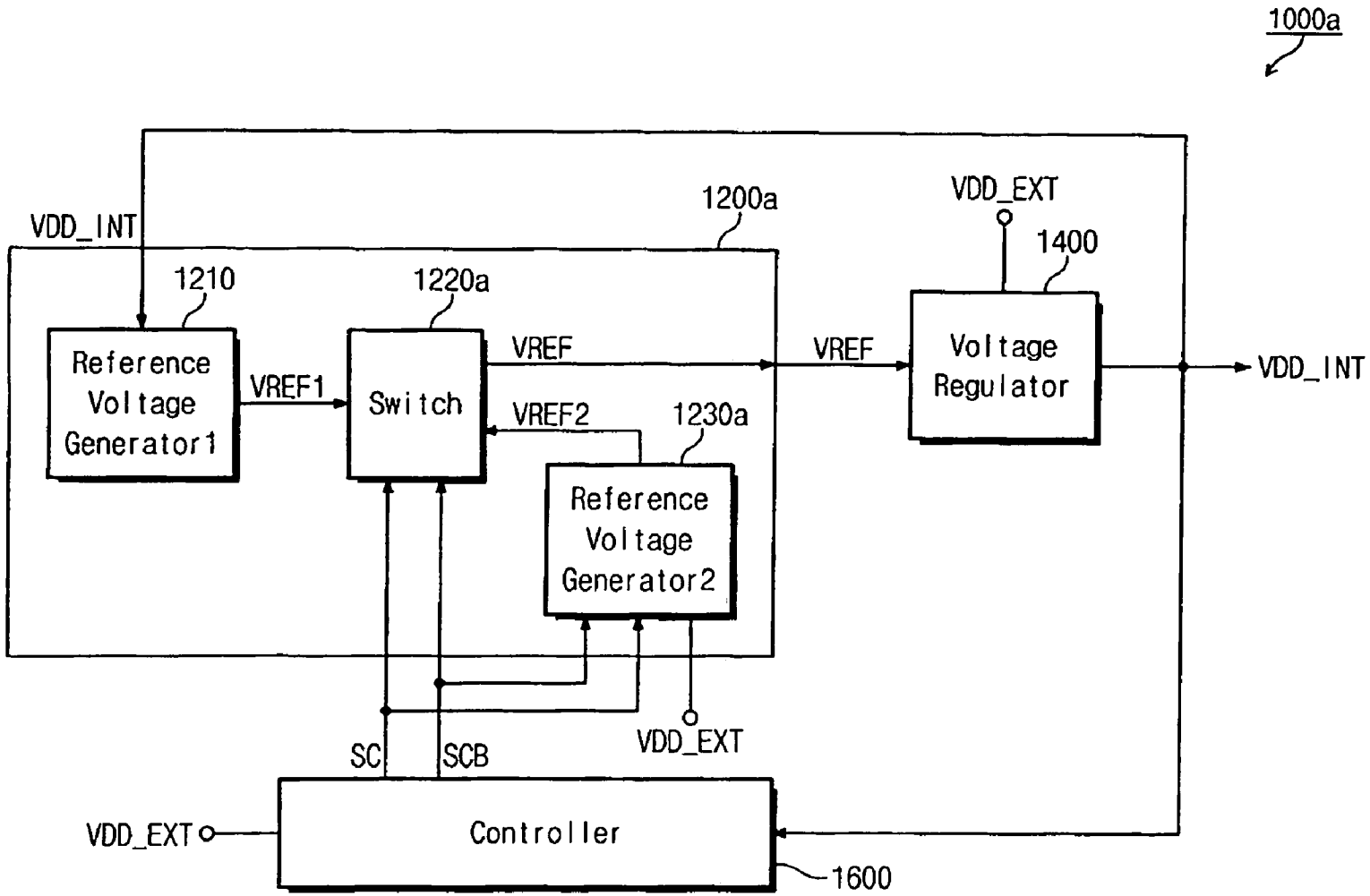
FIG. 6 is a schematic diagram showing an internal power voltage generator in accordance with another exemplary embodiment of the present disclosure.

Turning now to FIG. 6, an alternate embodiment internal power voltage generator in accordance with an exemplary embodiment of the present disclosure is indicated generally by the reference numeral 1000*a*. The internal power voltage generator 1000*a* is similar to the internal power voltage generator 1000 of FIG. 3 except for the new reference voltage generation block 1200*a*, so redundant description will be avoided.

The reference voltage generation block 1200*a* includes a first reference voltage generator 1210 for receiving the internal power voltage VDD_INT and providing a first reference voltage VREF1 to a switch 1220*a*, and a second reference voltage generator 1230*a* for receiving the external power voltage VDD_EXT and providing a second reference voltage VREF2 to the switch 1220*a*. The switch 1220*a* and the second reference voltage generator 1230*a* each receive the control signals SC and SCB from the controller 1600, and the switch provides one of the first and second reference voltages as the voltage reference VREF to the voltage regulator 1400.

Figure 7:
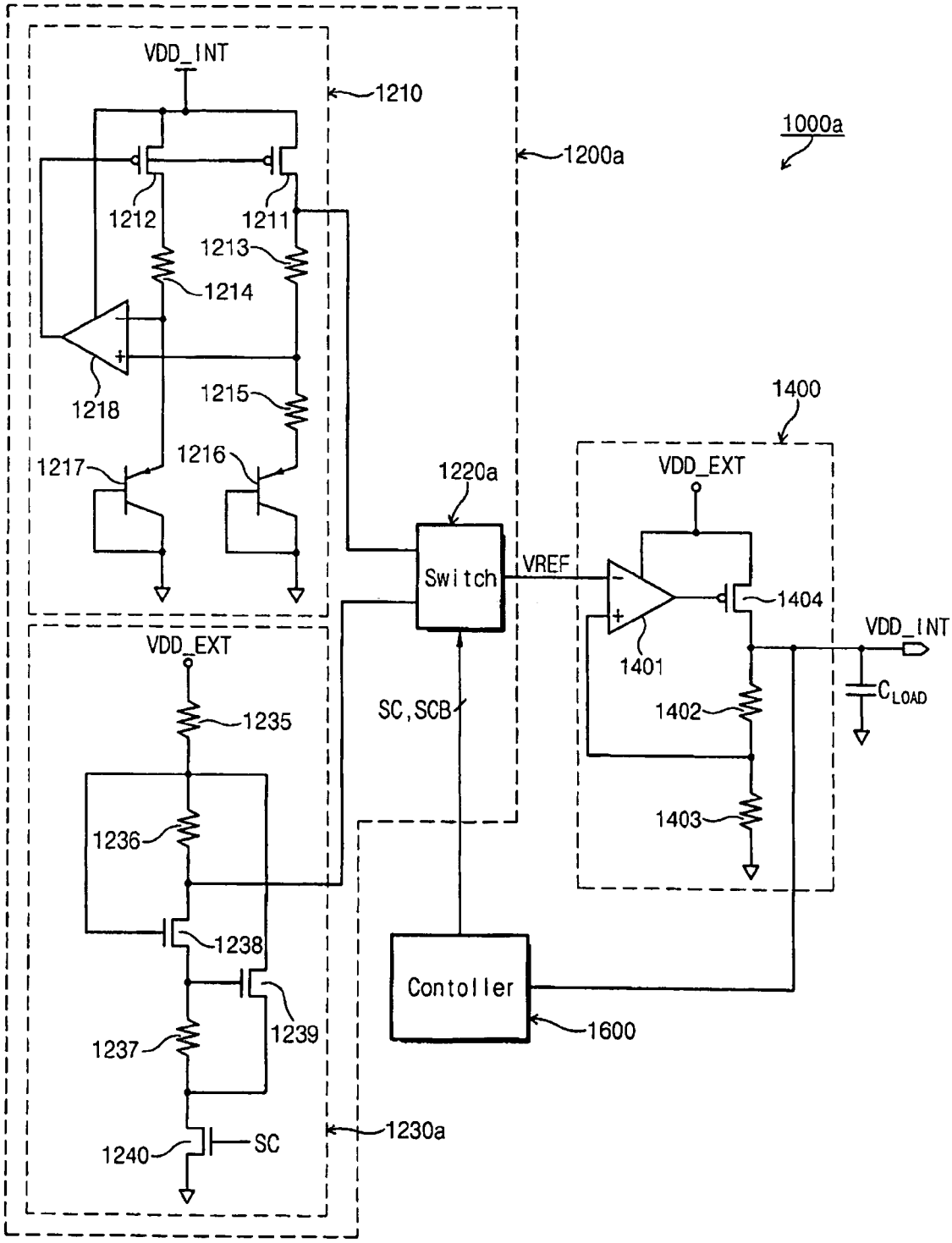
FIG. 7 is a schematic diagram showing the internal power voltage generator of FIG. 6 in greater detail.

As shown in FIG. 7, the internal power voltage generator 1000*a* of FIG. 6 is shown in greater detail. The reference voltage generation block 1200*a* includes a first reference voltage generator 1210, a second reference voltage generator 1230*a*, and a switch 1220*a* connected to each of the first and second reference voltage generators. The first reference voltage generator 1210 of FIG. 7 is like the first reference voltage generator 1210 of FIG. 4, so redundant description will be avoided.

The second reference voltage generator 1230*a* includes a first resistor 1235 connected to the external power voltage VDD_EXT. The other end of the first resistor 1235 is connected to a second resistor 1236, the gate of a first NMOS transistor 1238, and the drain of a second NMOS transistor 1239. The other end of the second resistor 1236 provides the second reference voltage VREF2 to the switch 1220*a*, and is also connected to the drain of the first NMOS transistor 1238. The source of the first NMOS transistor 1238 is connected to the gate of the second NMOS transistor 1239, as well as to a third resistor 1237. The other end of the third resistor 1237 is connected to the source of the second NMOS transistor 1239, as well as to the drain of a third NMOS transistor 1240. The gate of the third NMOS transistor 1240 is connected to the control signal SC from the controller 1600, and its source is connected to ground.

Figure 8:
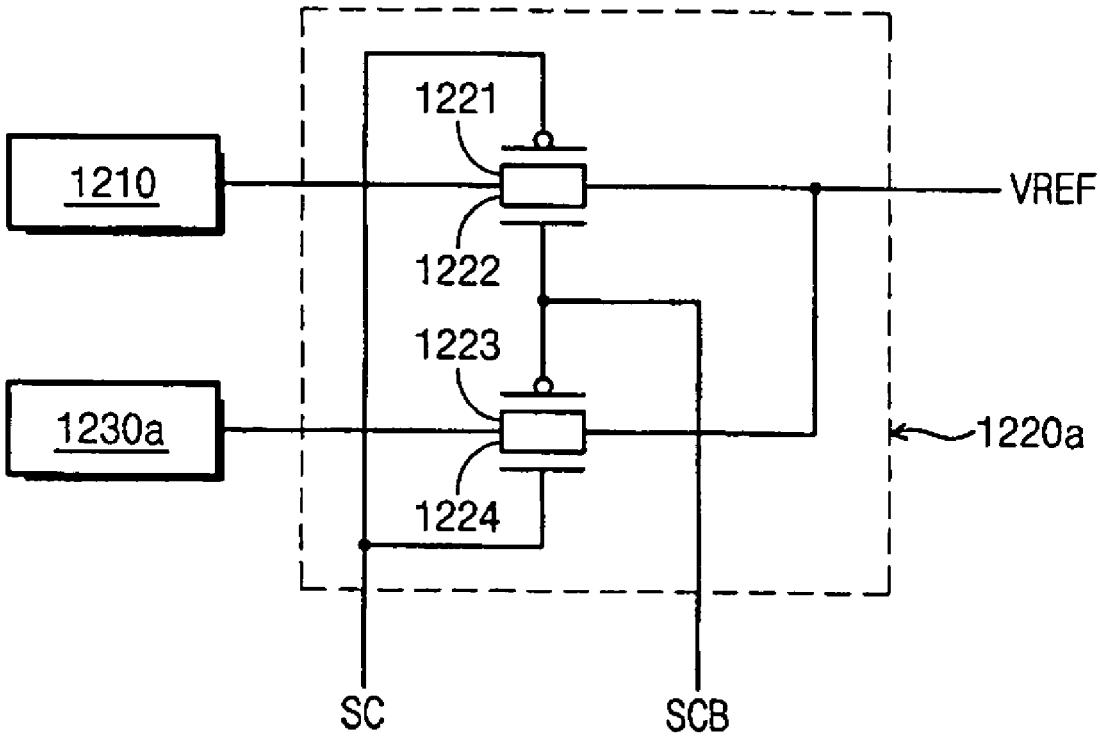
FIG. 8 is a schematic diagram showing a switch circuit of the internal power voltage generator of FIG. 7 in greater detail.

Turning to FIG. 8, the switch 1220*a* of FIG. 7 is shown in greater detail. The switch 1220*a* includes a first PMOS transistor 1221 and a first NMOS transistor 1222, connected source to drain and drain to source, respectively. The source of the first PMOS transistor 1221 is connected to the first reference voltage generator 1210 for receiving the first reference voltage signal VREF1, while the drain of the first PMOS transistor 1221 is connected to the switch output terminal for providing the reference voltage VREF. The gate of the first PMOS transistor 1221 is connected to the control signal SC from the controller 1600, while the gate of the first NMOS transistor 1222 is connected to the control signal SCB from the controller 1600. The gate of the first NMOS transistor 1222 is also connected to the gate of a second PMOS transistor 1223, which, in turn, is connected source-to-drain and drain-to-source with a second NMOS transistor 1224. The gate of the second NMOS transistor 1224 is connected to the control signal SC from the controller 1600. The source of the second PMOS transistor 1223 is connected to the second reference voltage generator 1230*a* for receiving the second reference voltage signal VREF2, while the drain of the second PMOS transistor 1223 is connected to the switch output terminal for providing the reference voltage VREF.

In operation, the reference voltage generators 1200 and 1200*a* of the present disclosure only have to operate within the narrow voltage range of the internal power voltage, unlike the conventional reference voltage generator 120 that has to operate within the wider voltage range of the possible external power voltages. Thus, preferred embodiment reference generators of the present disclosure are less complex and consume less current.

Preferred embodiment voltage regulators, such as 1400, may be the same as the conventional regulator 140. Preferred embodiment reference voltage generation blocks, such as 1200 and 1200*a*, include a first reference voltage generator or Ref_Gen1 1210, a second reference vol. generator Ref_Gen2, such as 1230 or 1230*a*, and a switch such as 1220 or 1220*a*.

The Ref_Gen1 1210 generates VREF1 through the switch using the internal power voltage VDD_INT generated from the voltage regulator 1400. The switch 1220 outputs VREF1 to the voltage regulator in response to control signals such as SC and/or SCB from a controller 1600. The Ref_Gen2 1230 generates VREF2 using the external power voltage VDD_EXT in response to control signals SC and/or SCB from the controller 1600. The block 1200 outputs either VREF1 or VREF2 to the voltage regulator as the reference voltage VREF.

The controller 1600 detects whether the VDD_INT, such as 1.5V, is higher than a detection voltage and outputs control signals SC and/or SCB as the detection result. Here, the detection voltage is the minimum operating voltage, such as 1.3V, which can generate the stable reference voltage VREF1 or VREF2. When the internal power voltage VDD_INT is lower than the detection voltage, such as during a power-up period, the controller 1600 outputs SC to logic high and/or SCB to logic low. The switch is deactivated and the Ref_Gen2 outputs VREF2 using VDD_EXT. The voltage regulator receives the reference voltage VREF2 from Ref_Gen2, and generates the internal power voltage VDD_INT.

When the internal power voltage VDD_INT reaches the detection voltage, the controller outputs SC to logic low and/or SCB to logic high. The switch is activated and the Ref_Gen1 outputs VREF1 using VDD_INT. The voltage regulator receives the reference voltage VREF1 from Ref_Gen1, and generates the internal power voltage (VDD_INT).

The block 1200 generates the reference voltage using VDD_EXT during the power-up sequence, and subsequently using VDD_INT instead of VDD_EXT. Preferably, the voltage level of VDD_INT is regulated to a limited range, such as between about 1.3V and 1.8V, for example, even though the voltage level of VDD_EXT may be varied over a wide range, such as between about 1.5V and 5.0V, for example.

The reference voltage generator can operate over a narrow range of voltage, such as between about 1.3V and 1.8V, because of the use of VDD_INT as its operating voltage. Thus, the reference voltage generator may have low complexity and/or low current consumption.

The controller 1600 includes the voltage detector 1610 and the level shifter 1620, where the voltage detector detects whether the internal voltage VDD_INT is higher than the detection voltage and outputs detection signals PWRUP and/or PWRUPB. The level shifter converts the detection signals PWRUP and/or PWRUPB into control signals SC and/or SCB for controlling the circuits of the switch and/or the second reference voltage generator Ref_Gen2, which uses the external voltage VDD_EXT.

The operational flow of the internal power voltage generator (IVG) as follows:

1. The external power voltage VDD_EXT is supplied to the IVG.

2. When the internal power voltage VDD_INT is lower than the predetermined detection voltage, such as during a power-up sequence, the detection signals PWRUP and/or PWRUPB become logic high or the VDD_INT level, and logic low or the ground level, respectively.

3. The level shifter converts the voltage level of the detection signals into control signals SC and/or SCB. SC becomes logic high or the VDD_EXT level, and SCB becomes logic low or the ground level.

4. A PMOS transistor 1231 and an NMOS transistor 1234 within the Ref_Gen2 1230 are turned-on by the control signals.

5. The Ref_Gen2 generates VREF2 using the external voltage VDD_EXT and outputs to an output terminal, such as the terminal 1001 of FIG. 4. The switch 1220 is inactivated by the control signals and the Ref_Gen1 1210 is not electrically connected to the output terminal 1001.

6. The voltage regulator 1400 generates the internal power voltage VDD_INT based on the reference voltage generated by the Ref_Gen2 1230.

7. When the voltage level of VDD_INT becomes higher than the detection voltage, according to an increase in the internal voltage level, such as in a post power-up sequence, the detection signals PWRUP and/or PWRUPB become logic low and logic high, respectively.

8. The controller 1600 outputs the control signals SC of logic low level and SCB of logic high level.

9. The PMOS 1231 and the NMOS 1234 are turned off, and the switch is activated.

10. VREF1 generated by Ref_Gen1 1210 is input to the voltage regulator 1400.

11. The voltage regulator generates VDD_INT using the reference voltage generated by the Ref_Gen1.

Operation of the alternate embodiment internal voltage generator 1000*a* of FIGS. 6 through 8 is similar to the above-described operation of the internal voltage generator 1000 embodiment of FIGS. 3 through 5 except for the operation of the reference voltage generation block 1200*a*.

The reference voltage generation block 1200*a* includes the Ref_Gen1 1210, the switch 1220*a*, and the Ref_Gen2 1230*a*. The Ref_Gen2 generates VREF2 using the external voltage VDD_EXT during the power-up sequence, for example. The Ref_Gen1 generates VREF1 using the internal voltage VDD_INT.

The switch 1220*a* selectively outputs one of VREF1 and VREF2 according to the control signals SC and SCB from the controller 1600. During the power-up sequence, the controller outputs the SC control signal of logic high level and the SCB control signal of logic low level, and the output VREF2 of Ref_Gen2 1230*a* is selected.

After the power-up sequence, the controller outputs SC of logic low level and SCB of logic high level, and the output VREF1 of Ref_Gen1 1210 is selected. The selected output from the switch, whether VREF1 or VREF2, becomes the reference voltage VREF and is sent to the voltage regulator 1400. The voltage regulator generates the internal power voltage based on the reference voltage.

Other alternate embodiments are intended, as will be understood by those of ordinary skill in the pertinent art. The controller may be implemented using a counter, for example. The external power-up information may be used to control the reference generators.

Although illustrative embodiments have been described herein with reference to the accompanying drawings, it is to be understood that the present invention is not limited to those precise embodiments, and that various changes and modifications may be effected therein by one of ordinary skill in the pertinent art without departing from the scope or spirit of the present invention. All such changes and modifications are intended to be included within the scope of the present invention as set forth in the appended claims.

What is claimed is:

1. An internal voltage generator comprising:

a first reference voltage generator for receiving an external voltage and providing a first reference voltage;

a second reference voltage generator for receiving an internal voltage and providing a second reference voltage; and a voltage regulator in signal communication with at least one of the first reference voltage generator and the second reference voltage generator for receiving one of the first and second reference voltages and providing the internal voltage.

2. An internal voltage generator as defined in claim 1, further comprising a controller in signal communication with the second reference voltage generator.

3. An internal voltage generator as defined in claim 2, the controller comprising:

an internal voltage detecting portion; and a level-shifting portion in signal communication with the internal voltage-detecting portion.

4. An internal voltage generator as defined in claim 3 wherein the controller enables at least one of the first reference voltage generator when the detected internal voltage is below a threshold, and the second reference voltage generator when the detected internal voltage is above a threshold.

5. An internal voltage generator as defined in claim 3 wherein the controller directs the switch to select one of the first reference voltage when the detected internal voltage is below a threshold, and the second reference voltage when the detected internal voltage is above a threshold.

6. An internal voltage generator as defined in claim 1, further comprising a switch in signal communication with at least one of the first and second reference voltage generators.

7. An internal voltage generator as defined in claim 6 wherein the voltage regulator is in signal communication with the switch.

8. An internal voltage generator as defined in claim 6 wherein the switch is in signal communication with the first and second reference voltage generators, and the voltage regulator is in signal communication with the switch.

9. An internal voltage generator as defined in claim 8 wherein the first reference voltage generator has a low gate count.

10. An internal voltage generator as defined in claim 6 wherein the switch is in signal communication with the second reference voltage generator, and the voltage regulator is in signal communication with the switch and the first reference voltage generator.

11. An internal voltage generator as defined in claim 10 wherein the switch has a low gate count.

12. An internal voltage generator as defined in claim 1, further comprising a controller in signal communication with the switch.

13. An internal voltage generator as defined in claim 12, the controller comprising a timer portion.

14. An internal voltage generator as defined in claim 13, the controller further comprising a level-shifting portion in signal communication with the timer portion.

15. An internal voltage generator as defined in claim 13 wherein the controller enables at least one of the first reference voltage generator when the timer is below a threshold, and the second reference voltage generator when the timer is above a threshold.

16. An internal voltage generator as defined in claim 13 wherein the controller directs the switch to select one of the first reference voltage when the timer is below a threshold, and the second reference voltage when the timer is above a threshold.

17. An internal voltage generator as defined in claim 1, the second reference voltage generator having an output driver with a greater current output than that of the first reference voltage generator.

18. An internal voltage generator as defined in claim 1, the second reference voltage generator comprising a circuit disposed for at least one of low current consumption, low gate count, and low part complexity.

19. An internal voltage generator as defined in claim 1 wherein the external voltage is provided external to at least one of the internal voltage generator and a chip comprising the internal voltage regulator.

20. A method for generating an internal voltage, the method comprising:

receiving an external voltage;

generating a first reference voltage responsive to the received external voltage;

regulating an internal voltage in correspondence with the first reference voltage;

generating a second reference voltage responsive to the internal voltage; and regulating the internal voltage in correspondence with the second reference voltage.

21. A method as defined in claim 20, further comprising:

detecting whether the internal voltage exceeds a threshold; and switching from regulating the internal voltage in correspondence with the first reference voltage to regulating the internal voltage in correspondence with the second reference voltage if the internal voltage does exceed the threshold.

22. A method as defined in claim 21, further comprising:

detecting whether the internal voltage exceeds a threshold; and switching from regulating the internal voltage in correspondence with the second reference voltage to regulating the internal voltage in correspondence with the first reference voltage if the internal voltage does not exceed the threshold.

23. A method as defined in claim 20, further comprising:

detecting whether a timer exceeds a threshold; and switching from regulating the internal voltage in correspondence with the first reference voltage to regulating the internal voltage in correspondence with the second reference voltage if the timer does exceed the threshold.

24. An internal voltage generator comprising:

first reference generating means for generating a first reference voltage responsive to an external voltage;

second reference generating means for generating a second reference voltage responsive to an internal voltage;

Voltage-regulating means for regulating the internal voltage in correspondence with at least one of the first and second reference voltages.

25. An internal voltage generator as defined in claim 24, further comprising:

detecting means for detecting whether the internal voltage exceeds a threshold; and switching means for switching from regulating the internal voltage in correspondence with the first reference voltage to regulating the internal voltage in correspondence with the second reference voltage if the internal voltage does exceed the threshold.

26. An internal voltage generator as defined in claim 25 wherein the switching means is disposed for switching from regulating the internal voltage in correspondence with the second reference voltage to regulating the internal voltage in correspondence with the first reference voltage if the internal voltage does not exceed the threshold.

* * * * *